US008325003B2

(12) United States Patent
Wu

(10) Patent No.: US 8,325,003 B2
(45) Date of Patent: Dec. 4, 2012

(54) COMMON MODE FILTER AND METHOD OF MANUFACTURING THE SAME

(75) Inventor: Liang Chieh Wu, Taipei County (TW)

(73) Assignee: INPAQ Technology Co., Ltd., Miaoli (TW)

( * ) Notice: Subject to any disclaimer, the term of this patent is extended or adjusted under 35 U.S.C. 154(b) by 10 days.

(21) Appl. No.: 13/210,495

(22) Filed: Aug. 16, 2011

(65) Prior Publication Data

US 2012/0119863 A1 May 17, 2012

(30) Foreign Application Priority Data

Nov. 15, 2010 (TW) ..... 99139152 A

(51) Int. Cl.
*H01F 5/00* (2006.01)
*H01F 27/28* (2006.01)
*H03H 7/00* (2006.01)

(52) U.S. Cl. ..... 336/200; 336/232; 333/181; 333/185

(58) Field of Classification Search ..... 336/192, 336/200, 232; 333/181, 185
See application file for complete search history.

(56) References Cited

U.S. PATENT DOCUMENTS

| | | | | |
|---|---|---|---|---|
| 5,955,931 | A * | 9/1999 | Kaneko et al. | 333/175 |
| 6,356,181 | B1 | 3/2002 | Kitamura | |
| 6,618,929 | B2 | 9/2003 | Kitamura | |
| 7,064,629 | B2 * | 6/2006 | Shoji | 333/185 |
| 7,145,427 | B2 | 12/2006 | Yoshida et al. | |
| 7,446,632 | B2 * | 11/2008 | Tomonari et al. | 333/185 |
| 7,692,527 | B2 * | 4/2010 | Ito et al. | 336/200 |
| 7,911,295 | B2 * | 3/2011 | Inuzuka et al. | 333/185 |
| 2006/0158301 | A1 * | 7/2006 | Shinkai et al. | 336/232 |

* cited by examiner

*Primary Examiner* — Mohamad Musleh
*Assistant Examiner* — Tsz Chan
(74) *Attorney, Agent, or Firm* — WPAT, P.C.; Anthony King

(57) ABSTRACT

A common mode filter includes at least two inductance unit sets. Each inductance unit set includes a coil leading layer, an insulating substrate, at least two electrically conductive columns, and a coil main body layer. The coil leading layer is disposed on a first surface of the substrate, and includes at least two leading wires, at least four leading terminals, and at least two contacts. Each leading wire respectively connects one leading terminal and one contact. The coil main body layer is disposed on a second surface of the substrate, and includes a coil lead and two end portions thereof. Each electrically conductive column extends through the substrate, connecting one contact and one end portion. The two substrates and two coil main body layers of the at least two inductance unit sets are bonded by an electrically insulating layer. The two coil main body layers are electrically isolated from each other by the electrically insulating layer.

7 Claims, 7 Drawing Sheets

COMMON MODE FILTER AND METHOD OF MANUFACTURING THE SAME

BACKGROUND OF THE INVENTION

1. Technical Field

The present invention relates to a common mode filter and its manufacturing method, and relates more particularly to a common mode filter that can be manufactured using a method of manufacturing printed circuit boards.

2. Background

Common mode filters are devices for suppressing common mode currents, which travel in the same direction in parallel wires, generally produce common mode radiation, and cause electromagnetic interference. To be used in portable communication devices, common mode filters need to be miniaturized and have highly compact structures. Thus, thin-film type common mode filters and multi-layer common mode filters are gradually replacing conventional wire-wound common mode filters. As their names imply, conventional wire-wound common mode filters include a cylindrical ferrite core and a wire around the ferrite core. The thin-film type common mode filter requires many semiconductor manufacturing processes to manufacture. For example, the coil of a thin-film type common mode filter is planar, which is formed on a plate-like ferrite using photolithography technique. In addition, the multi-layer common mode filter is formed with a plate-like ferrite, on which a coil is screen printed and sintered.

U.S. Pat. No. 7,145,427 B2 discloses a common mode filter that allows adjustability of the common mode impedance of the coil of a common mode filter. A coil is formed on a magnetic substrate and a portion of non-coil structures formed by filling a resin including magnetic powder into regions, on the magnetic substrate, from which the insulation layer has been removed. The magnetic substrates are then planarized and bonded to obtain the common mode filter.

U.S. Pat. Nos. 6,356,181 B1 and 6,618,929 B2 disclose multi-layer common mode filters. A coil is formed on a magnetic substrate and covered by magnetic material. In the two patents, different wire layouts of the coils are proposed for decreasing impedance for differential signals. However, because the wire layouts are continuous and distributed in different layers, the common mode filters are complicated, requiring more control factors.

Thus, the market needs a common mode filter that can be easily manufactured and is compatible with present manufacturing techniques. As such, the drawbacks of conventional common mode filters can be overcome and manufacturing costs can be reduced.

SUMMARY

The present invention provides a common mode filter with a simple structure. The common mode filter includes an inductance unit set. A plurality of inductance unit sets can be formed simultaneously in a substrate, being similar to the method of forming printed circuit boards. Attaching a plurality of inductance unit sets together forms the common mode filter. Using processes similar to the method for forming printed circuit boards allows the common mode filter to be easily mass-produced. The substrate including inductance unit sets can withstand a reflow soldering temperature and will not incur additional manufacturing cost.

The present invention provides a common mode filter, which comprises at least two inductance unit sets and an electrically insulating layer. Each inductance unit set comprises an insulating substrate, a coil leading layer, a coil main body layer, and at least two electrically conductive columns. The insulating substrate comprises a first surface and a second surface. The coil leading layer is disposed on the first surface of the insulating substrate. The coil leading layer includes at least two leading wires, at least four leading terminals, and at least two contacts. Each leading wire connects a respective one of the leading terminals and a respective one of the contacts. The coil main body layer is disposed on the second surface of the insulating substrate and includes a coil lead and two end portions thereof. The at least two electrically conductive columns extend through the insulating substrate. Each electrically conductive column connects a respective one of the contacts and a respective one of the two end portions. The electrically insulating layer bonds the two insulating substrates of the at least two inductance unit sets, and bonds the two coil main body layers of the at least two inductance unit sets, and electrically isolates the two coil main body layers from each other.

The present invention discloses a method of manufacturing a common mode filter, comprising providing two insulating substrates each including two metal layers on two surfaces of the insulating substrate, forming two through holes on each insulating substrate, filling metal in the through holes, performing a photolithographic process on each insulating substrate to pattern one of the metal layers as a coil leading layer and another of the metal layers as a coil main body layer, and bonding the two insulating substrates and the two coil main body layers using an electrically insulating layer. The metal in the through holes connects the coil leading layers and the coil main body layers. The two coil main body layers are electrically separated from each other by the electrically insulating layer.

The foregoing has outlined rather broadly the features of the present invention in order that the detailed description of the invention that follows may be better understood. Additional features of the invention will be described hereinafter, and form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The objectives of the present invention will become apparent upon reading the following description and upon reference to the accompanying drawings in which.

DETAILED DESCRIPTION OF THE INVENTION

Figure 1:
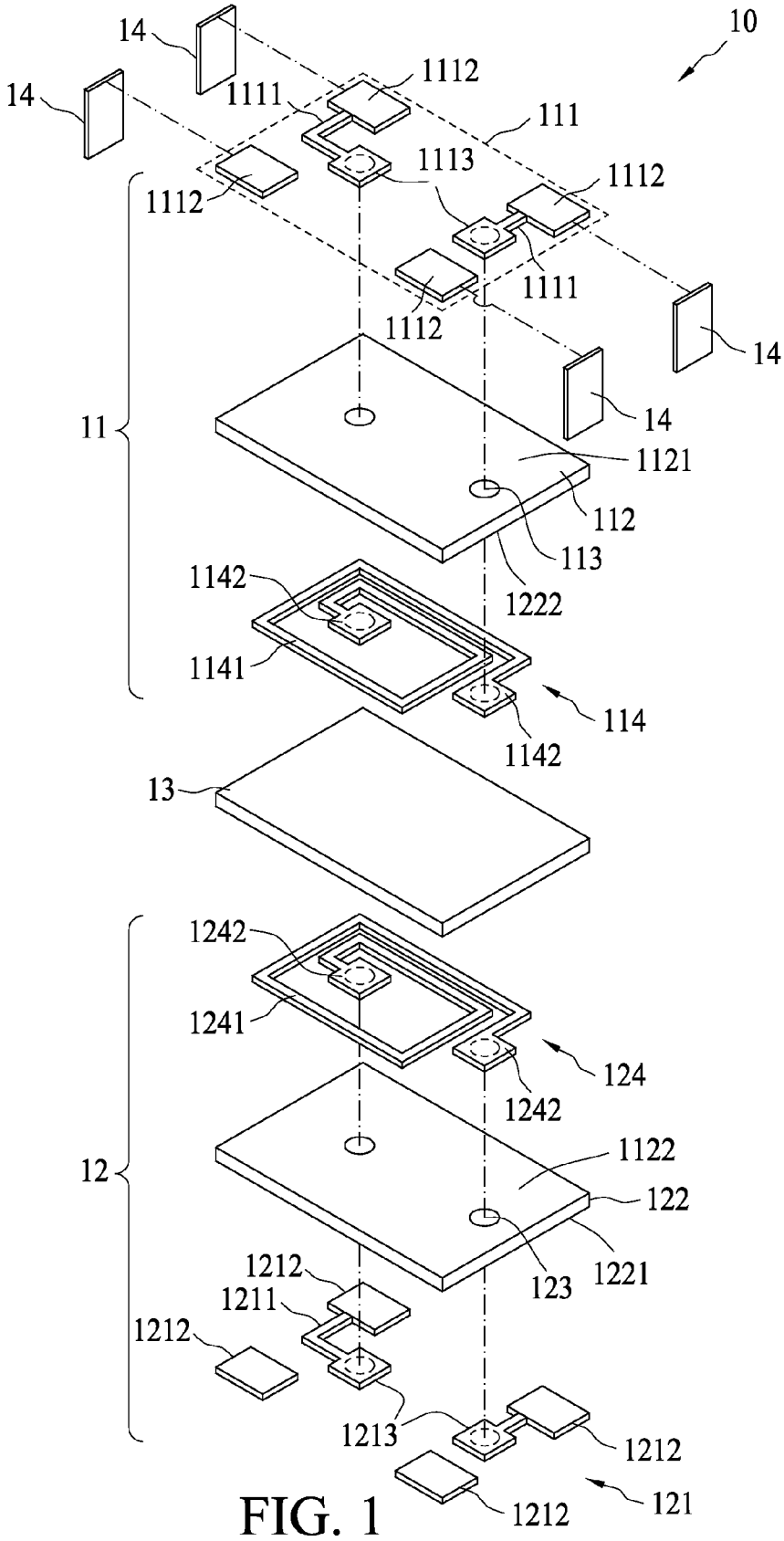
FIG. 1 is an exploded view showing a common mode filter according to one embodiment of the present invention.

FIG. 1 is an exploded view showing a common mode filter according to one embodiment of the present invention. As shown in FIG. 1, the common mode filter 10 comprises a first inductance unit set 11, a second inductance unit set 12, an electrically insulating layer 13, and four electrode portions 14, wherein the first inductance unit set 11 and the second inductance unit set 12 are attached to each other by the electrically insulating layer 13.

The first inductance unit set 11 comprises a first coil leading layer 111, a first insulating substrate 112, at least two first electrically conductive columns 113, and a first coil main body layer 114. The first coil leading layer 111 is disposed on a first surface 1121 of the first insulating substrate 112, comprising at least two first leading wires 1111, at least four first leading terminals 1112, and at least two first contacts 1113. Each first leading wire 1111 connects one respective first leading terminal 1112 to one respective first contact 1113. The first coil main body layer 114 is disposed on a second surface 1222 of the first insulating substrate 112, comprising a first coil lead 1141 and two first end portions 1142 thereof. The at least two first electrically conductive columns 113 extend through the first insulating substrate 112, and respectively connect the at least two (upper) first contacts 1113 to the two (lower) first end portions 1142.

The second inductance unit set 12 has a configuration symmetrical to that of the first inductance unit set 11 relative to a middle layer, which is the electrically insulating layer 13. The second inductance unit set 12 comprises a second coil leading layer 121, a second insulating substrate 122, two second electrically conductive columns 123, and a second coil main body layer 124. The second coil leading layer 121 is disposed on a first surface 1221 of the second insulating substrate 122, comprising at least two second leading wires 1211, at least four second leading terminals 1212, and at least two second contacts 1213. Each second leading wire 1211 connects one respective second leading terminal 1212 to one respective second contact 1213. The second coil main body layer 124 is disposed on a second surface 1122 of the second insulating substrate 122, comprising a second coil lead 1241 and two first end portions 1242. The two second electrically conductive columns 123 extend through the second insulating substrate 122, and respectively connect the at least two (lower) second contacts 1213 to the two (upper) second end portions 1242.

The first and second insulating substrates 112 and 122 can be made of polyimide, resin or thermal plastics, or can be an epoxy/glass fibre composite or a thermally cured dry film.

The electrically insulating layer 13 bonds the first and second insulating substrates 112 and 122 together, and the first and second coil main body layers 114 and 124 together, and electrically isolates the first coil main body layers 114 from the second coil main body layers 124. The electrically insulating layer 13 can be an adhesive, and the first and second coil main body layers 114 and 124 can be inserted in the electrically insulating layer 13. In FIG. 1, although the electrically insulating layer 13 is demonstrated as a plate-like cuboid, it is in fact an adhesive bonding layer enclosing the first and second coil main body layers 114 and 124.

The four electrode portions 14 respectively connect the four first leading terminals 1112 and the four second leading terminals 1212. As a result, the first and second coil main body layers 114 and 124 can be operated similarly to two inductance coils coupled by mutual inductance.

The first inductance unit set 11 and the second inductance unit set 12 of the common mode filter 10 can respectively use a double-sided copper-clad laminate. Through holes connecting the upper copper circuit layer to the lower circuit layer can be formed by a mechanical drilling process, a laser ablation process, a plasma etching process, or a chemical wet etching process. Chemical copper plating can be applied to deposit copper on walls of the through holes and accumulate to form the first and second electrically conductive columns 113 and 123. A copper plating process can be further applied to increase the thickness of the copper layers on the through holes and the substrate surface of the first and second insulating substrates 112 and 122 to a desired thickness.

Dry film photoresist is provided to the surfaces of the copper metal layers of the double-sided copper-clad laminate. After exposure and development, circuit patterns are defined on the copper metal layers. The photolithographic process for conventional printed circuit boards can be used to define the patterns of the first and second coil main body layers 114 and 124 and the first and second coil leading layers 111 and 121. Unprotected portions of the copper metal layers are then etched away. As a result, the copper circuit patterns on the first and second insulating substrates 112 and 122 are formed.

The two finished double-sided copper-clad laminates including the first and second inductance unit sets 11 and 12 are bonded with the electrically insulating layer 13. The entire bonded stacked substrates are cut into pieces of predetermined size. Consequently, a plurality of common mode filters are obtained.

Figure 2:
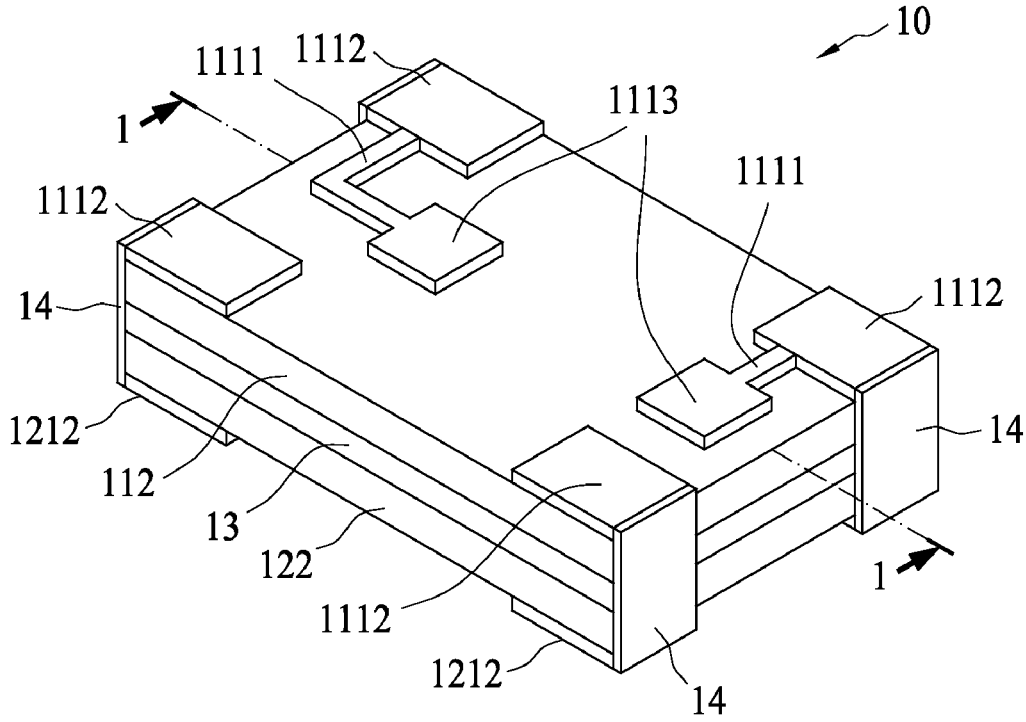
FIG. 2 is a perspective view showing the common mode filter of FIG. 1.
Figure 3:
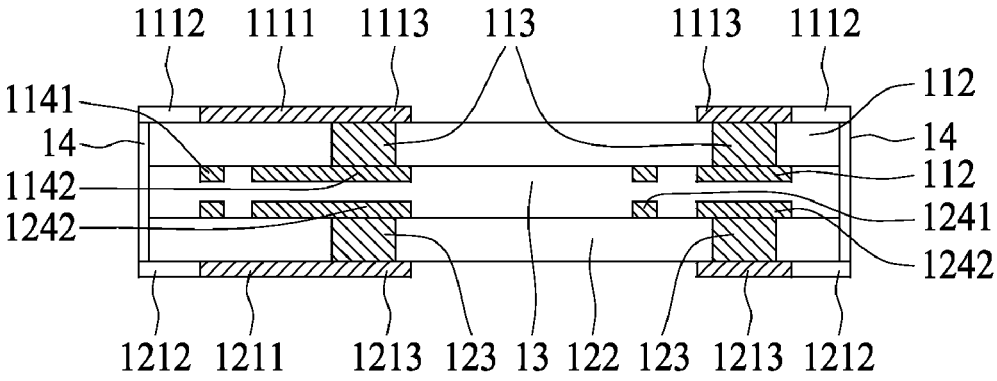
FIG. 3 is a sectional view along line 1-1 of FIG. 2.

FIG. 2 is a perspective view showing the common mode filter of FIG. 1. FIG. 3 is a sectional view along line 1-1 of FIG. 2. As shown in FIGS. 2 and 3, the first and second inductance unit sets 11 and 12 are symmetrical relative to the middle layer, which is the electrically insulating layer 13.

Figure 4:
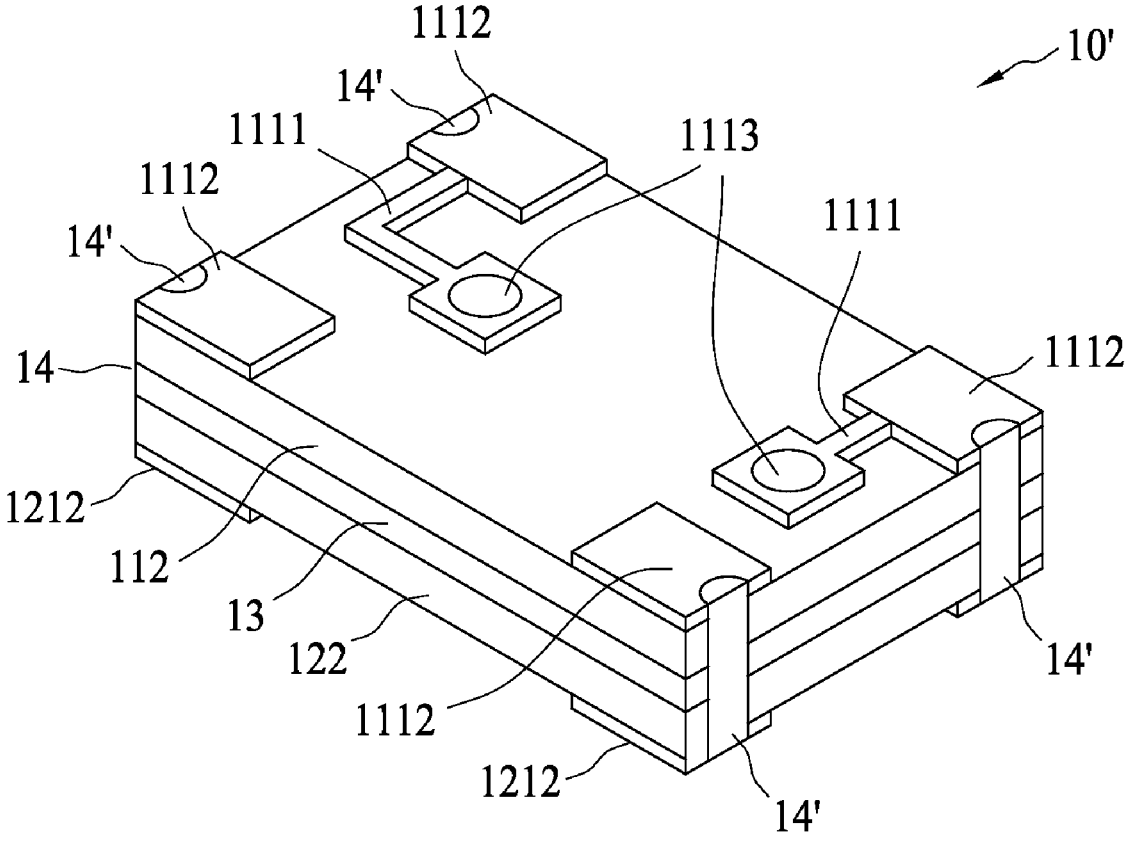
FIG. 4 is a perspective view showing a common mode filter according to another embodiment of the present invention.

FIG. 4 is a perspective view showing a common mode filter 10' according to another embodiment of the present invention. Referring to FIG. 4, the common mode filter 10' includes four electrode portions 14, which are semi-cylindrical metal members. The electrode portions 14 with such shape can improve the electrical connections between the first and second leading terminals 1112 and 1212. The four electrode portions 14 can be inserted in the lateral sides of the first and second insulating substrates 112 and 122 and the electrically insulating layer 13.

Figure 5:
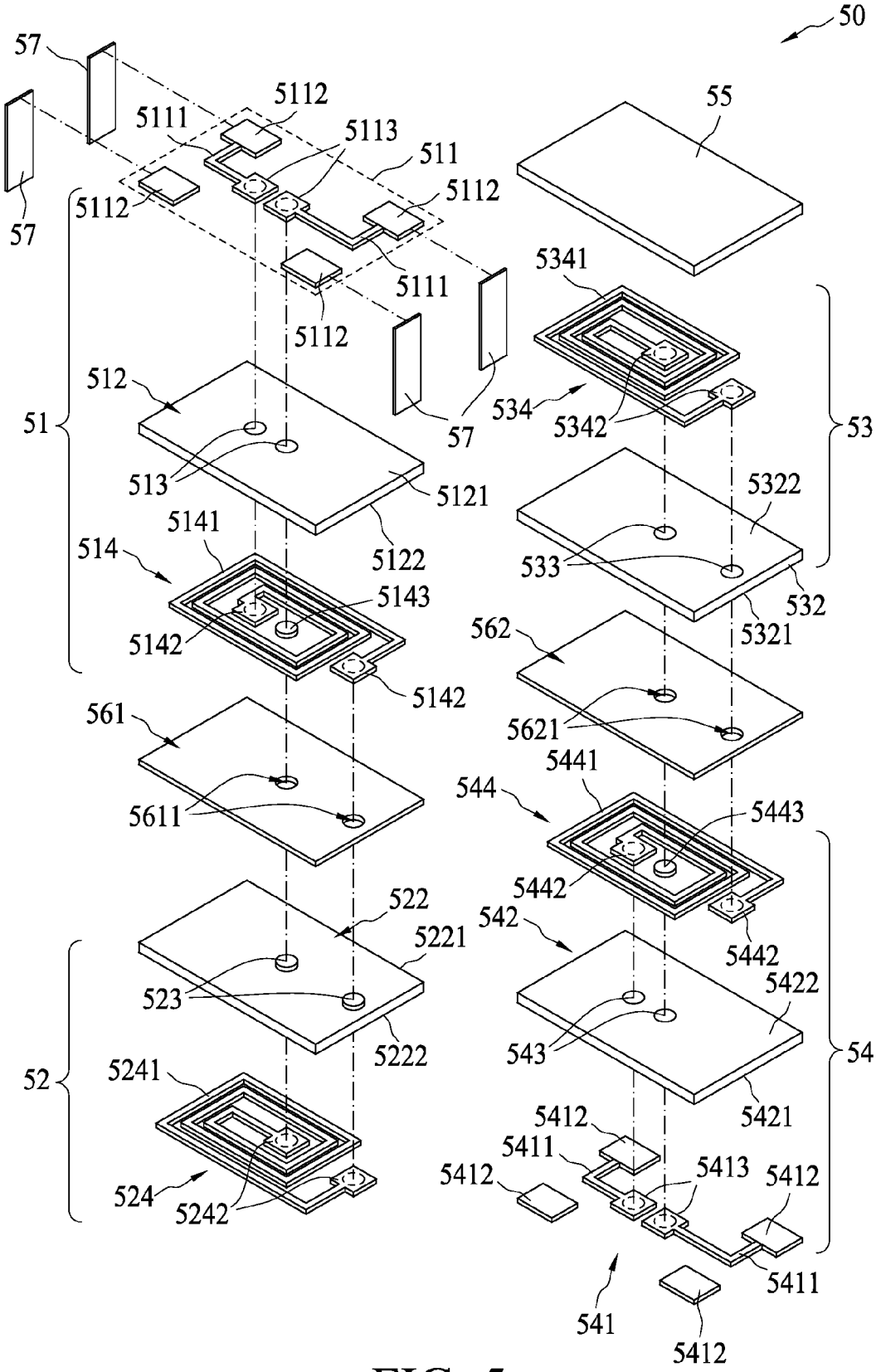
FIG. 5 is an exploded view showing a common mode filter according to another embodiment of the present invention.

FIG. 5 is an exploded view showing a common mode filter according to another embodiment of the present invention. As shown in FIG. 5, the common mode filter 50 comprises a first inductance unit set 51, a second inductance unit set 52, a third inductance unit set 53, a fourth inductance unit set 54, a major electrically insulating layer 55, a first electrically insulating layer 561, a second electrically insulating layer 562, and four electrode portions 57. The first electrically insulating layer 561 bonds the first and second inductance unit sets 51 and 52, and the inductance coils of the two unit sets 51 and 52 are serially connected. Similarly, the second electrically insulating layer 562 bonds the third and fourth inductance unit sets 53 and 54, while the inductance coils of the two unit sets 53 and 54 are serially connected.

The first inductance unit set 51 comprises a first coil leading layer 511, a first insulating substrate 512, at least two first electrically conductive columns 513, and a first coil main body layer 514. The first coil leading layer 511 is disposed on a first surface 5121 of the first insulating substrate 512, comprising at least two first leading wires 5111, at least four first leading terminals 5112, and at least two first contacts 5113.

Each first leading wire 5111 connects a respective one of the at least four first leading terminals 5112 to a respective one of the at least two first contacts 5113. The first coil main body layer 514 is disposed on a second surface 5122 of the first insulating substrate 512, comprising a first coil lead 5141, a first end portion 5142, and a conductive pad 5143, wherein the first end portion 5142 and the conductive pad 5143 are respectively on opposite ends of the first coil lead 5141. The at least two first electrically conductive columns 513 extend through the first insulating substrate 512, configured respectively to connect one of the at least two (upper) first contacts 5113 to the first end portion 5142 of the first coil lead 5141 and to connect another of the at least two (upper) first contacts 5113 to the (lower) conductive pad 5143.

The second inductance unit set 52 comprises a second insulating substrate 522, two second electrically conductive columns 523, and a second coil main body layer 524. The two second electrically conductive columns 523 extend through the second insulating substrate 522, protruding from a first surface 5221 of the second insulating substrate 522, passing through the through holes 5611 in the first electrically insulating layer 561, and connecting respectively with the conductive pad 5143 and the first end portion 5142. The second coil main body layer 524 is disposed on a second surface 5222 of the second insulating substrate 522, comprising a second coil lead 5241 and two second end portions 5242 thereof. The two second electrically conductive columns 523 extend through the second insulating substrate 522, configured respectively to connect the conductive pad 5143 to one second (lower) end portion 5242 and to connect the first (upper) end portion 5142 to another second (lower) end portion 5242.

The third inductance unit set 53 has a configuration symmetrical to that of the second inductance unit set 52, and the fourth inductance unit set 54 has a configuration symmetrical to that of the first inductance unit set 51. The above four inductance unit sets are symmetrical about the middle layer, which is the electrically insulating layer 55. The third inductance unit set 53 comprises a third insulating substrate 532, at least two second electrically conductive columns 533, and a third coil main body layer 534. The two second electrically conductive columns 533 extend through the third insulating substrate 532, protruding from a first surface 5321 of the third insulating substrate 532, passing through the through holes 5621 in the second electrically insulating layer 562, and connecting respectively with the conductive pad 5443 and a fourth end portion 5442 of a fourth coil main body layer 544 in the fourth inductance unit set 54. The third coil main body layer 534 is disposed on a second surface 5322 of the third insulating substrate 532, comprising a third coil lead 5341 and two third end portions 5342. The at least two second electrically conductive columns 533 extend through the third insulating substrate 532, configured respectively to connect the conductive pad 5443 to a third (lower) end portion 5342 and to connect the fourth (upper) end portion 5442 to another third (lower) end portion 5342.

The fourth inductance unit set 54 comprises a fourth coil leading layer 541, a fourth insulating substrate 542, at least two fourth electrically conductive columns 543, and a fourth coil main body layer 544. The fourth coil leading layer 541 is disposed on a first surface 5421 of the fourth insulating substrate 542, comprising at least two fourth leading wires 5411, at least four fourth leading terminals 5412, and at least two fourth contacts 5413. Each fourth leading wire 5411 connects a respective one of the at least four fourth leading terminals 5412 to a respective one of the at least two fourth contacts 5413. The fourth coil main body layer 544 is disposed on a second surface 5422 of the fourth insulating substrate 542, comprising a fourth coil lead 5441, a fourth end portion 5442, and a conductive pad 5443, wherein the fourth end portion 5442 and the conductive pad 5443 are respectively on opposite ends of the fourth coil lead 5441. The at least two fourth electrically conductive columns 543 extend through the fourth insulating substrate 542, configured respectively to connect one (lower) contact 5413 to the fourth end portion 5442 and to connect another (lower) contact 5413 to the (upper) conductive pad 5443.

Each of the four electrode portions 57 connects a respective leading terminal 5112 and a respective fourth leading terminal 5412. Consequently, the inductance coil formed by the first and second coil main body layers 514, 524 is coupled with the inductance coil formed by the third and fourth coil main body layers 534, 544 by mutual inductance.

Processes similar to those used for manufacturing the common mode filter 10 of FIG. 1 can be used to manufacture the common mode filter in FIG. 5. A double-sided copper-clad laminate or a single-sided copper-clad laminate is selected for forming first, second, third, and fourth inductance unit sets 51 to 54. Manufactured laminates are then bonded together.

Figure 6:
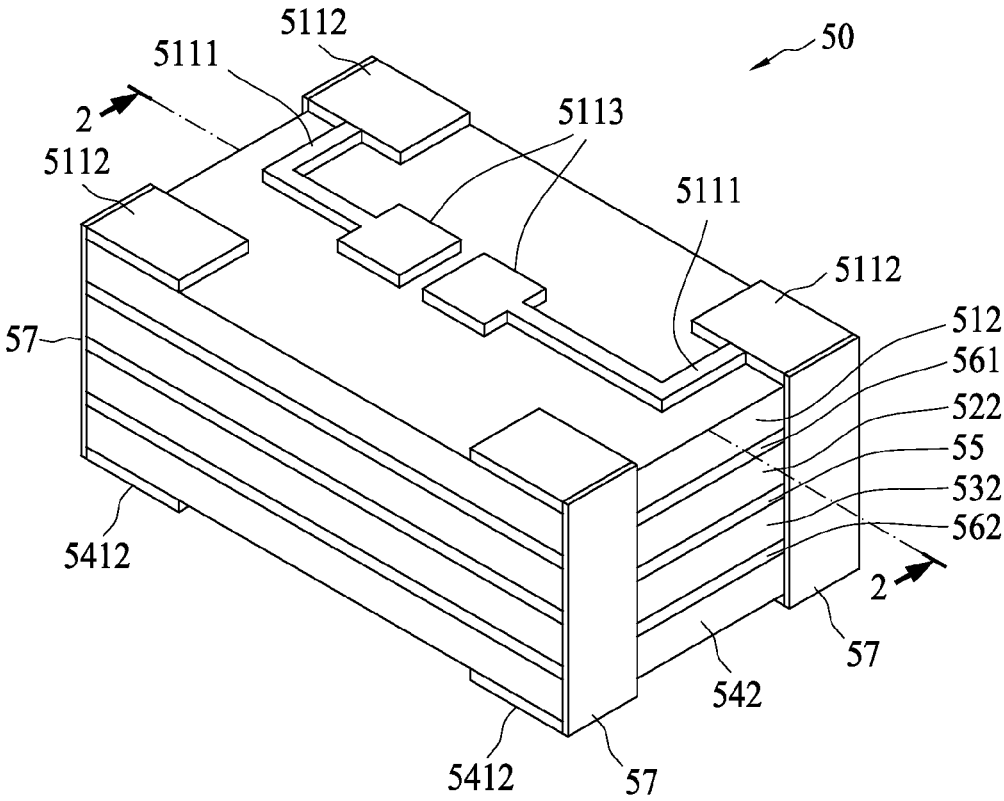
FIG. 6 is a perspective view showing the common mode filter of FIG. 5.
Figure 7:
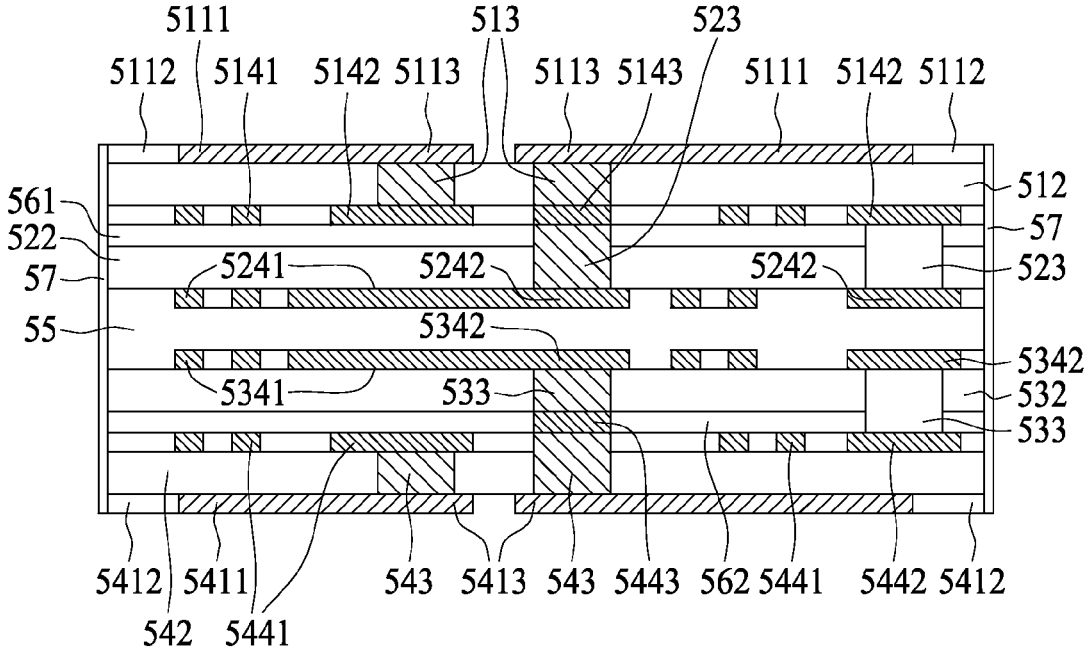
FIG. 7 is a sectional view along line 2-2 of FIG. 6.

FIG. 6 is a perspective view showing the common mode filter of FIG. 5. FIG. 7 is a sectional view along line 2-2 of FIG. 6. As shown in FIGS. 6 and 7, with respective to the electrically insulating layer 55, the third inductance unit set 53 has a configuration symmetrical to that of the second inductance unit set 52, and the fourth inductance unit set 54 has a configuration symmetrical to that of the first inductance unit set 51.

Figure 8:
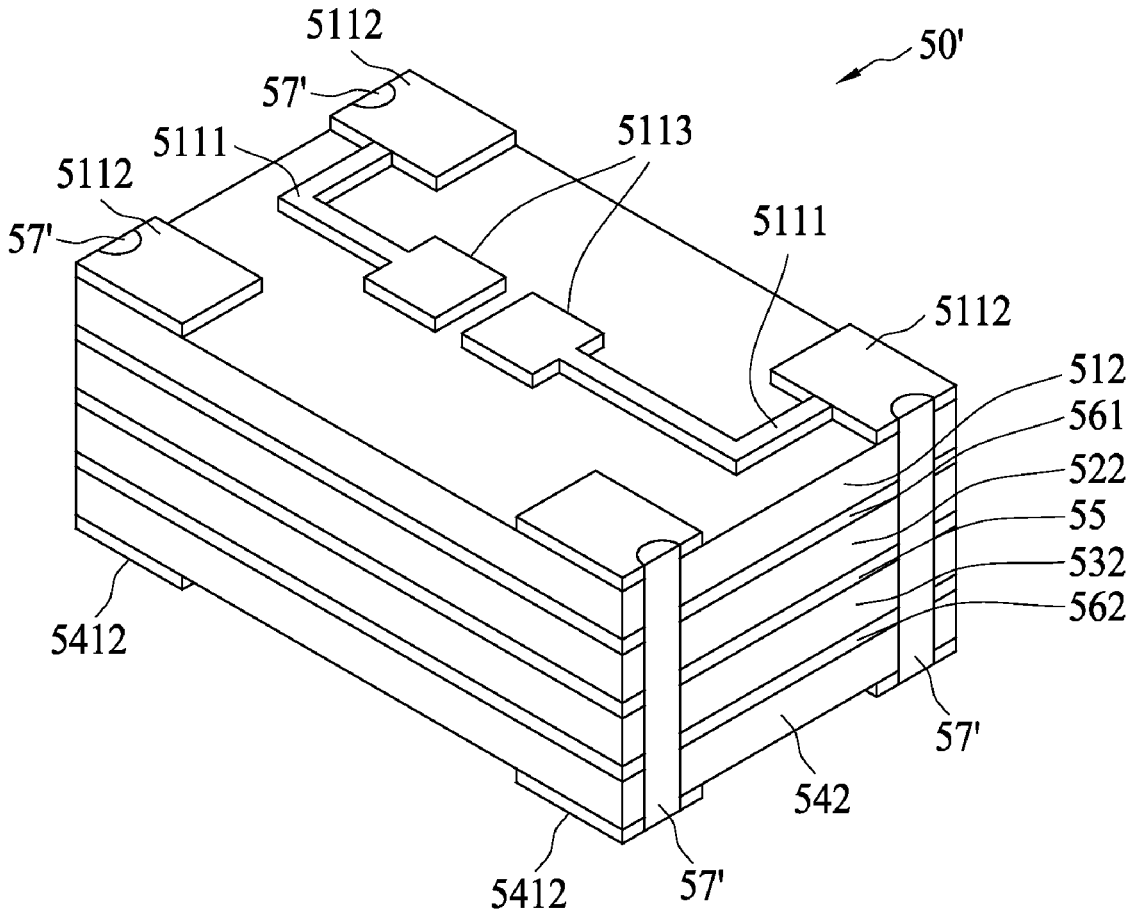
FIG. 8 is a perspective view showing a common mode filter according to another embodiment of the present invention.

FIG. 8 is a perspective view showing a common mode filter according to another embodiment of the present invention. Referring to FIG. 8, the common mode filter 50' includes four electrode portions 57', which are semi-cylindrical metal members. The electrode portions 57' with such shape can improve the electrical connections between the first and fourth leading terminals 5112 and 5412.

Figure 9:
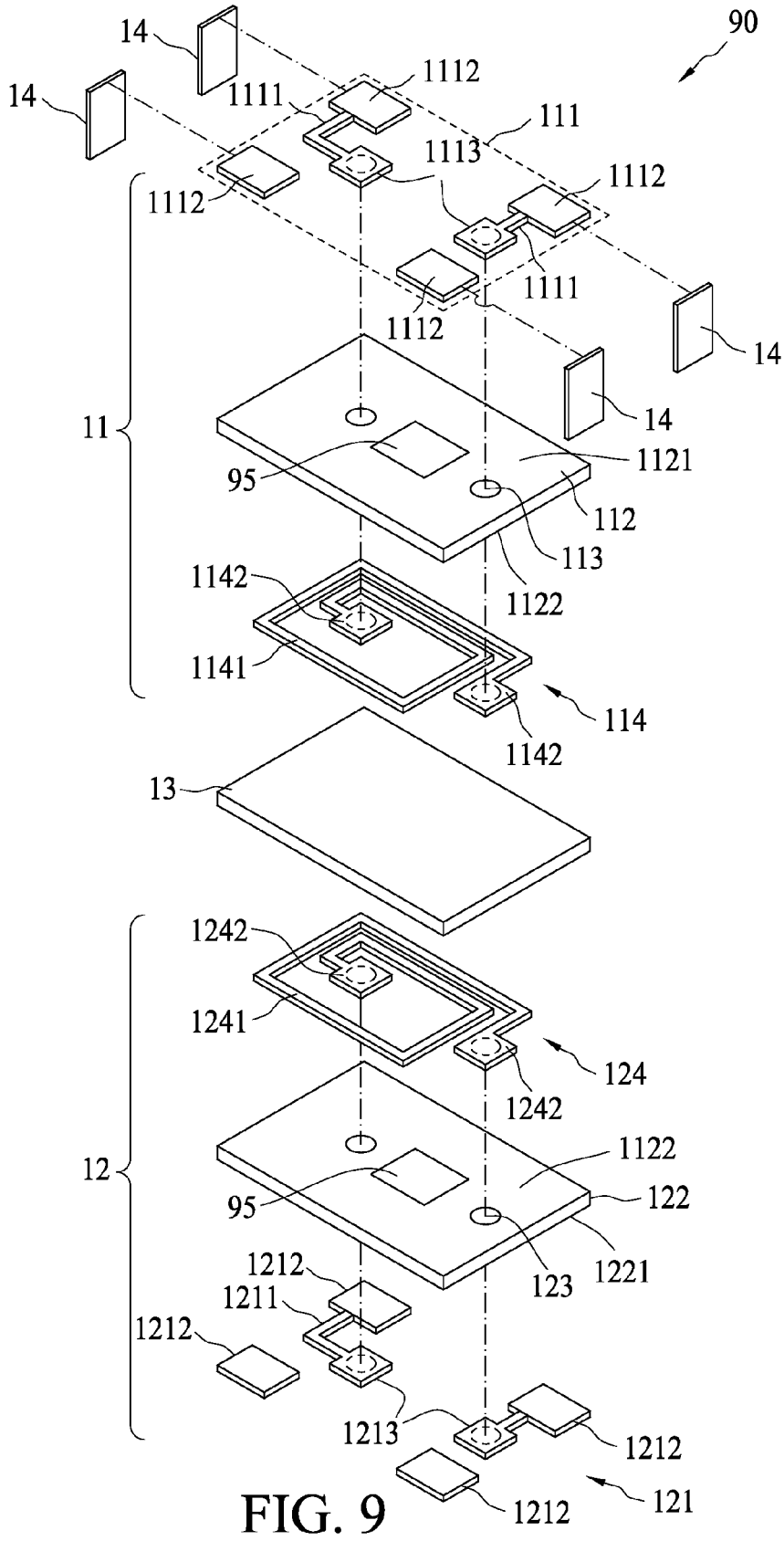
FIG. 9 is an exploded view showing a common mode filter according to one embodiment of the present invention.

FIG. 9 is an exploded view showing a common mode filter according to one embodiment of the present invention. Referring to FIG. 9, in the center portions of the first and second insulating substrates 112, 122 of the common mode filter 90, cavities are formed and filled with adhesive including magnetic powder by a screen-printing process to form magnetic material portions 95, which can improve the effectiveness of removing common mode noise.

Although the present invention and its objectives have been described in detail, it should be understood that various changes, substitutions and alterations can be made herein without departing from the spirit and scope of the invention as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A common mode filter, comprising:

at least two inductance unit sets, each inductance unit set comprising:

an insulating substrate comprising a first surface and a second surface;

a coil leading layer disposed on the first surface of the insulating substrate, including at least two leading wires, at least four leading terminals, and at least two contacts, each leading wire connecting a respective one of the leading terminals and a respective one of the contacts;

a coil main body layer disposed on the second surface of the insulating substrate, including a coil lead and two end portions thereof; and at least two electrically conductive columns through the insulating substrate, each connecting a respective one of the contacts and a respective one of the two end portions; and an electrically insulating layer bonding the two insulating substrates of the at least two inductance unit sets, bonding the two coil main body layers of the at least two inductance unit sets, electrically isolating the two coil main body layers from each other.

2. The common mode filter of claim 1, wherein the coil main body layers are formed symmetrically relative to the electrically insulating layer, and the coil leading layers of the at least two inductance unit sets are formed symmetrically relative to the electrically insulating layer.

3. The common mode filter of claim 1, further comprising four electrode portions, wherein each electrode portion connects a respective one of the at least four leading terminals of one of the at least two inductance unit sets to a respective one of the at least four leading terminals of another of the at least two inductance unit sets.

4. The common mode filter of claim 3, wherein the coil leads of the coil main body layers of the at least two inductance unit sets are connected in parallel.

5. The common mode filter of claim 3, wherein the four electrode portions are inserted in lateral sides formed by the insulating substrate and the electrically insulating layer.

6. The common mode filter of claim 1, wherein the insulating substrate comprises polyimide, resin or thermal plastics, or is an epoxy/glass fibre composite or a thermally cured dry film.

7. The common mode filter of claim 1, wherein the insulating substrate comprises a magnetic material portion formed at the center of the coil main body layers of the at least two inductance unit sets.

* * * * *